US006637526B2

(12) United States Patent
Juhasz et al.

(10) Patent No.: US 6,637,526 B2
(45) **Date of Patent: *Oct. 28, 2003**

(54) OFFSET ELEVATOR FOR A PIPE RUNNING TOOL AND A METHOD OF USING A PIPE RUNNING TOOL

(75) Inventors: Daniel Juhasz, Westminister, CA (US); George Boyadjieff, Villa Park, CA (US); Brian L. Eidem, Cerritos, CA (US); Hans van Rijzingen, Etten-Leur (NL)

(73) Assignee: Varco I/P, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/029,585

(22) Filed: Dec. 20, 2001

(65) Prior Publication Data

US 2003/0000742 A1 Jan. 2, 2003

Related U.S. Application Data

(63) Continuation-in-part of application No. 09/518,122, filed on Mar. 3, 2000, now Pat. No. 6,443,241.
(60) Provisional application No. 60/122,915, filed on Mar. 5, 1999.

(51) Int. Cl.[7] ..... E21B 19/06
(52) U.S. Cl. ..... 175/52; 175/85; 166/77.51
(58) Field of Search ..... 175/52, 85, 162; 166/77.51, 77.52, 77.53, 85.1; 414/22.51

(56) References Cited

U.S. PATENT DOCUMENTS

| | | | | |
|---|---|---|---|---|
| 3,193,116 A | | 7/1965 | Kenneday et al. | 214/2.5 |
| 3,742,562 A | | 7/1973 | Haby | 24/263 |
| 4,023,449 A | * | 5/1977 | Boyadjieff | 81/57.16 |
| 4,389,760 A | | 6/1983 | Krasnov | 24/263 |
| 4,449,596 A | | 5/1984 | Boyadjieff | 175/85 |
| 4,529,045 A | | 7/1985 | Boyadjieff et al. | 173/164 |
| 4,570,706 A | | 2/1986 | Pugnet | 166/77.5 |

(List continued on next page.)

FOREIGN PATENT DOCUMENTS

| | | | |
|---|---|---|---|
| EP | 0 311 455 | 4/1989 | E21B/19/16 |
| EP | 0 525 247 | 2/1993 | E21B/3/02 |
| WO | 96/18799 | 6/1996 | E21B/19/16 |
| WO | 98/11322 | 3/1998 | E21B/19/16 |
| WO | 99/30000 | 6/1999 | E21B/19/20 |

OTHER PUBLICATIONS

International Search Report relating to corresponding International Application No. PCT/US00/05752 dated Sep. 28, 2000.

Invitation to Pay Additional Fees relating to corresponding International Application No. PCT/US00/05752 dated Jun. 30, 2000.

Kamphorst, Herman and Bottger, Dietrich; *Casing Running Tool;* A feasibility study; QCD Management and Consultancy; pp. 1–30.

Kamphorst, G.H., van Wechen, G.L., Bottger, D. and Koch, K.; *Casing Running Tool;* SPE/IADC 52770; pp. 1–9.

*Primary Examiner*—William Neuder
(74) *Attorney, Agent, or Firm*—Christie, Parker & Hale

(57) ABSTRACT

A pipe running tool for use in an oil drilling system and the like comprises a lower drive shaft adapted to engage a drive shaft of a top drive assembly for rotation therewith. The pipe running tool further includes a lower pipe engagement assembly which is driven to rotate by the lower drive shaft, and is designed to releasably engage a pipe segment in such a manner to substantially prevent relative rotation between the two. Thus, when the lower pipe engagement assembly is actuated to securely hold a pipe segment, the top drive assembly may be actuated to rotate the top drive output shaft, which causes the lower drive shaft and lower pipe engagement assembly to rotate, which in turn rotates the pipe segment. The pipe running tool having a greater slip back offset such that drill pipe and drill pipe tool joints may be passed through the central passageway of the tool without interfering with the front of the slip.

19 Claims, 6 Drawing Sheets

U.S. PATENT DOCUMENTS

| | | | | |
|---|---|---|---|---|
| 4,605,077 | A | 8/1986 | Boyadjieff | 175/85 |
| 4,709,766 | A | 12/1987 | Boyadjieff | 175/82 |
| 4,781,359 | A | 11/1988 | Matus | 267/71 |
| 4,791,997 | A | 12/1988 | Krasnov | 175/57 |
| 5,785,132 | A | 7/1998 | Richardson et al. | |
| 5,839,330 | A | 11/1998 | Stokka | 81/57.33 |
| 6,443,241 | B1 * | 9/2002 | Juhasz et al. | 175/52 |

* cited by examiner

OFFSET ELEVATOR FOR A PIPE RUNNING TOOL AND A METHOD OF USING A PIPE RUNNING TOOL

CROSS-REFERENCE TO RELATED APPLICATION(S)

This application is a continuation-in-part of patent application Ser. No. 09/518,122, filed Mar. 3, 2000, now U.S. Pat. No. 6,443,241 which claims priority to provisional patent application serial No. 60/122,915 filed Mar. 5, 1999.

BACKGROUND OF THE INVENTION

1. Field of the Invention

This invention relates to well drilling operations and, more particularly, to a device for assisting in the assembly of pipe strings, such as casing strings, drill strings and the like.

2. Description of the Related Art

The drilling of oil wells involves assembling drill strings and casing strings, each of which comprises a plurality of elongated, heavy pipe segments extending downwardly from an oil drilling rig into a hole. The drill string consists of a number of sections of pipe which are threadedly engaged together, with the lowest segment (i.e., the one extending the furthest into the hole) carrying a drill bit at its lower end. Typically, the casing string is provided around the drill string to line the well bore after drilling the hole and ensure the integrity of the hole. The casing string also consists of a plurality of pipe segments which are threadedly coupled together and formed with through passages sized to receive the drill string and/or other pipe strings.

The conventional manner in which plural casing segments are coupled together to form a casing string is a labor-intensive method involving the use of a "stabber" and casing tongs. The stabber is manually controlled to insert a segment of casing into the upper end of the existing casing string, and the tongs are designed to engage and rotate the segment to threadedly connect it to the casing string. While such a method is effective, it is cumbersome and relatively inefficient because the procedure is done manually. In addition, the casing tongs require a casing crew to properly engage the segment of casing and to couple the segment to the casing string. Thus, such a method is relatively labor-intensive and therefore costly. Furthermore, using casing tongs requires the setting up of scaffolding or other like structures, and is therefore inefficient.

Others have proposed a casing running tool for assembling casing strings which utilizes a conventional top drive assembly. The tool includes a pivotable manipulator which is designed to engage a pipe segment and raise the pipe segment up into a power assist spider, which relies on gravity to hold the pipe segment. The spider is coupled to the top drive and may be rotated by it. Thus, the pipe segment may be brought into contact with a casing string and the top drive activated to rotate the casing segment and threadedly engage it with the casing string.

While such a system provides benefits over the more conventional systems used to assemble casing strings, such a system suffers from shortcomings. One such shortcoming is that the casing segment may not be sufficiently engaged by the power assist spider to properly connect the casing segment with the casing string. In addition, the system fails to provide any means for effectively controlling the load applied to the threads at the bottom of the casing segment, as well as to the top of the casing string when the casing segment is lowered onto the string. Without the ability to control these loads, cross-threading may occur, resulting in stripped threads and a useless casing segment.

Accordingly, it will be apparent to those skilled in the art that there continues to be a need for a device for use in a drilling system which utilizes an existing top drive assembly to efficiently assemble casing and/or drill strings, and which positively engages a pipe segment to ensure proper coupling of the pipe segment to a pipe string. In addition, the need exists for a load compensator to compensate for both upwardly and downwardly directed loads that are applied to either the casing string or the casing segment. The present invention addresses these needs and others.

SUMMARY OF THE INVENTION

Briefly, and in general terms, the present invention is directed to a pipe running tool for use in drilling systems and the like to assemble casing and/or drill strings. The pipe running tool is coupled to an existing top drive assembly which is used to rotate a drill string, and includes a powered elevator that is powered into an engaged position to securely engage a pipe segment, for example, a casing segment. Because the elevator is powered into the engaged position, the pipe segment may be properly coupled to an existing pipe string using the top drive assembly.

The system of the present invention in one illustrative embodiment is directed to a pipe running tool mountable on a rig and including: a top drive assembly adapted to be connected to the rig for vertical displacement of the top drive assembly relative to the rig, the top drive assembly including a drive shaft, the top drive assembly being operative to rotate the drive shaft; and a lower pipe engagement assembly including a central passageway sized for receipt of the pipe segment, the lower pipe engagement assembly including a powered engagement device that is powered to an engaged position to securely and releasably grasp the pipe segment, the lower pipe engagement assembly being in communication with the drive shaft, whereby actuation of the top drive assembly causes the lower pipe engagement assembly to rotate.

In still another illustrative embodiment, the system of the present invention is directed to a pipe running tool having a greater slip back offset such that drill pipe and drill pipe tool joints may be passed through the central passageway of the tool without interfering with the front of the slip. In such an embodiment, the pipe running tool may utilize a three-slip design capable of providing a larger central passageway and greater load bearing capability such that both casing and drill pipe may be backed-up using the pipe running tool alone.

In yet another illustrative embodiment, the system of the present invention is directed to a pipe running tool having slips further comprising detachable insert carriers attached thereto, the insert carriers being capable of being inserted onto the front of the slips such that the diameter of the central passageway can be quickly altered based on the dimension of the insert carrier allowing the running of different sized tubulars through the pipe running tool with a single slip set.

In still yet another illustrative embodiment, the present invention is directed to a method of assembling a pipe string, including the steps of: actuating a lower pipe engagement assembly to releasably engage a pipe segment; lowering a top drive assembly to bring the pipe segment into contact with a pipe string; monitoring the load on the pipe string; actuating a load compensator to raise the pipe segment a selected distance relative to the pipe string, if the load on the pipe string exceeds a predetermined threshold value; and actuating the top drive assembly to rotate the pipe segment to threadedly engage the pipe segment and pipe string.

In still yet another embodiment, the present invention is directed to a method of running casing or drill pipe into a borehole utilizing the pipe running tool comprising, using the top drive to impart rotational and vertical motion to the casing or drill pipe through the pipe running tool.

Other features and advantages of the present invention will become apparent from the following detailed description, taken in conjunction with the accompanying drawings which illustrate, by way of example, the features of the present invention.

DETAILED DESCRIPTION OF THE INVENTION

Figure 1:
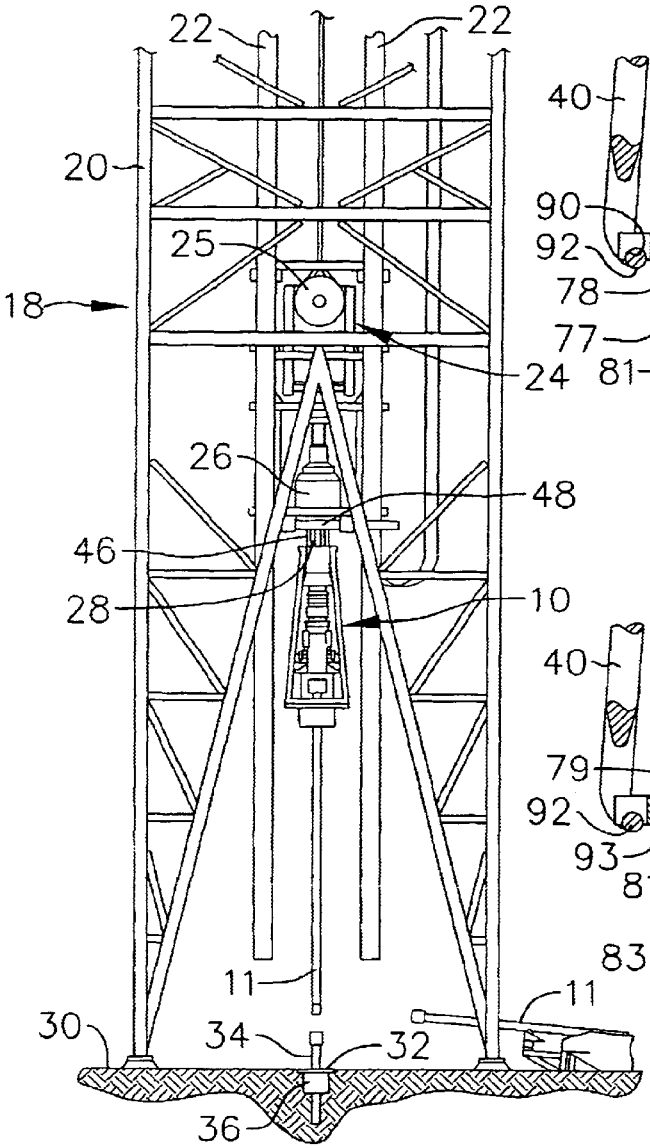
FIG. 1 is an elevated side view of a drilling rig incorporating a pipe running tool according to one illustrative embodiment of the present invention.
Figure 2:
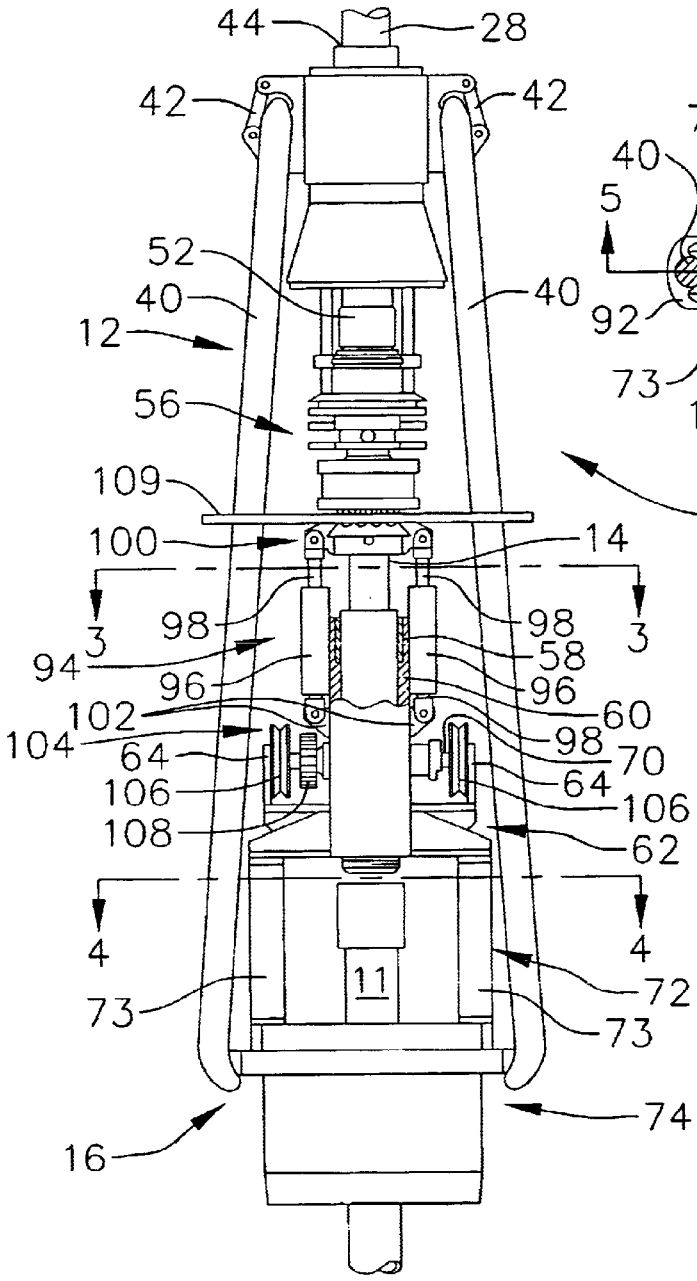
FIG. 2 is a side view, in enlarged scale, of the pipe running tool of FIG. 1.
Figure 4:
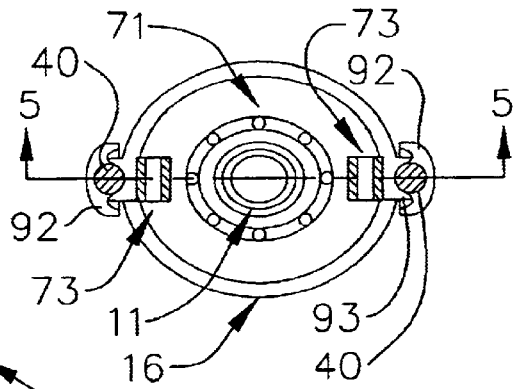
FIG. 4 is a cross-sectional view taken along the line 4—4 of FIG. 2.
Figure 3:
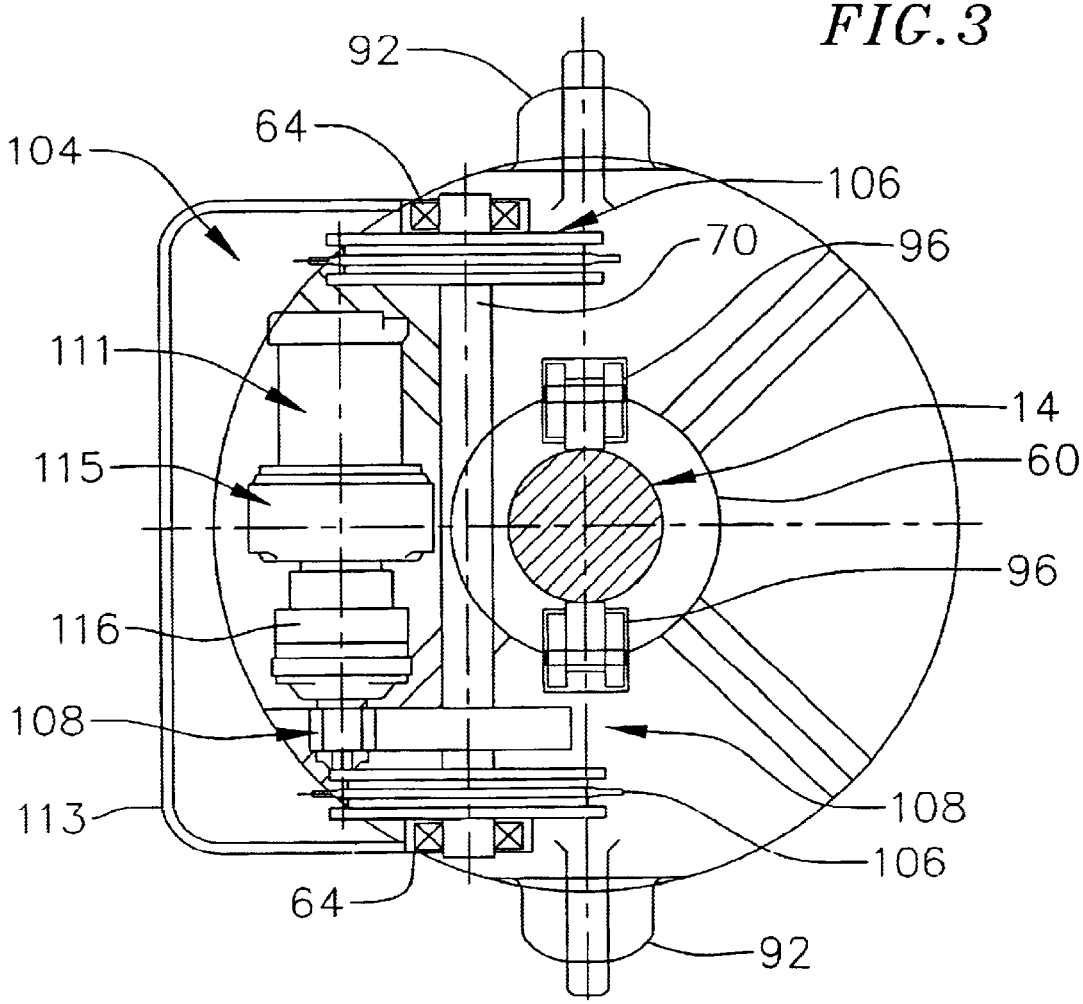
FIG. 3 is a cross-sectional view taken along the line 3—3 of FIG. 2.

In the following detailed description, like reference numerals will be used to refer to like or corresponding elements in the different figures of the drawings. Referring now to FIGS. 1 and 2, there is shown a pipe running tool 10 depicting one illustrative embodiment of the present invention, which is designed for use in assembling pipe strings, such as drill strings, casing strings, and the like. The pipe running tool 10 comprises, generally, a frame assembly 12, a rotatable shaft 14, and a lower pipe engagement assembly 16 that is coupled to the rotatable shaft for rotation therewith. The pipe engagement assembly is designed for selective engagement of a pipe segment 11 (FIGS. 1, 2, and 5A) to substantially prevent relative rotation between the pipe segment and the pipe engagement assembly. The rotatable shaft 14 is designed for coupling with a top drive output shaft from an existing top drive, such that the top drive, which is normally used to rotate a drill string to drill a well hole, may be used to assemble a pipe string, for example, a casing string or a drill string, as is described in greater detail below.

The pipe running tool 10 is designed for use, for example, in a well drilling rig 18. A suitable example of such a rig is disclosed in U.S. Pat. No. 4,765,401 to Boyadjieff, which is expressly incorporated herein by reference as if fully set forth herein. As shown in FIG. 1, the rig includes a frame 20 and a pair of guide rails 22 along which a top drive assembly, generally designated 24, may ride for vertical movement relative to the rig. The top drive assembly is preferably a conventional top drive used to rotate a drill string to drill a well hole, as is described in U.S. Pat. No. 4,605,077 to Boyadjieff, which is expressly incorporated herein by reference. The top drive assembly includes a drive motor 26 and a top drive output shaft 28 extending downwardly from the drive motor, with the drive motor being operative to rotate the drive shaft, as is conventional in the art. The rig defines a drill floor 30 having a central opening 32 through which a drill string and/or casing string 34 is extended downwardly into a well hole.

The rig 18 also includes a flush-mounted spider 36 that is configured to releasably engage the drill string and/or casing string 34 and support the weight thereof as it extends downwardly from the spider into the well hole. As is well known in the art, the spider includes a generally cylindrical housing which defines a central passageway through which the pipe string may pass. The spider includes a plurality of slips which are located within the housing and are selectively displaceable between disengaged and engaged positions, with the slips being driven radially inwardly to the respective engaged positions to tightly engage the pipe segment and thereby prevent relative movement or rotation of the pipe segment and the spider housing. The slips are preferably driven between the disengaged and engaged positions by means of a hydraulic or pneumatic system, but may be driven by any other suitable means.

Referring primarily to FIG. 2, the pipe running tool 10 includes the frame assembly 12, which comprises a pair of links 40 extending downwardly from a link adapter 42. The link adapter defines a central opening 44 through which the top drive output shaft 28 may pass. Mounted to the link adapter on diametrically opposed sides of the central opening are respective upwardly extending, tubular members 46 (FIG. 1), which are spaced a predetermined distance apart to allow the top drive output shaft 28 to pass therebetween. The respective tubular members connect at their upper ends to a rotating head 48, which is connected to the top drive assembly 24 for movement therewith. The rotating head defines a central opening (not shown) through which the top drive output shaft may pass, and also includes a bearing (not shown) which engages the upper ends of the tubular members and permits the tubular members to rotate relative to the rotating head body, as is described in greater detail below.

The top drive output shaft 28 terminates at its lower end in an internally splined coupler 52 which is engaged to an upper end of the lower drive shaft 14 (not shown) which is formed to complement the splined coupler for rotation therewith. Thus, when the top drive output shaft 28 is rotated by the top drive motor 26, the lower drive shaft 14 is also rotated. It will be understood that any suitable interface may be used to securely engage the top and lower drive shafts together.

In one illustrative embodiment, the lower drive shaft 14 is connected to a conventional pipe handler, generally designated 56, which may be engaged by a suitable torque wrench (not shown) to rotate the lower drive shaft and thereby make and break connections that require very high torque, as is well known in the art.

The lower drive shaft 14 is also formed with a splined segment 58, which is slidably received in an elongated, splined bushing 60 which serves as an extension of the lower drive shaft. The drive shaft and bushing are splined to provide for vertical movement of the shaft relative to the bushing, as is described in greater detail below. It will be understood that the splined interface causes the bushing to rotate when the lower drive shaft rotates.

The pipe running tool 10 further includes the lower pipe engagement assembly 16, which in one embodiment comprises a torque transfer sleeve 62 which is securely connected to the lower end of the bushing 60 for rotation therewith. The torque transfer sleeve is generally annular and includes a pair of upwardly projecting arms 64 on diametrically opposed sides of the sleeve. The arms are formed with respective horizontal through passageways (not shown) into which are mounted respective bearings (not shown) which serve to journal a rotatable axle 70 therein, as described in greater detail below. The transfer sleeve connects at its lower end to a downwardly extending torque frame 72 in the form of a pair of tubular members 73, which in turn is coupled to a spider\elevator 74 which rotates with the torque frame. It will be apparent that the torque frame may take many, such as a plurality of tubular members, a solid body, or any other suitable structure.

Figure 5A:
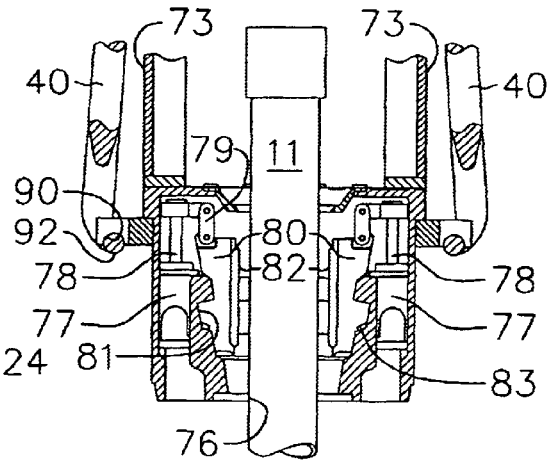
FIG. 5A is a cross-sectional view taken along the line 5—5 of FIG. 4 and showing a spider\elevator in a disengaged position.

The spider\elevator 74 is preferably powered by a hydraulic or pneumatic system, or alternatively by an electric drive motor or any other suitable powered system. In the embodiment disclosed, the spider\elevator includes a housing 75 which defines a central passageway 76 through which the pipe segment 11 may pass. The spider\elevator also includes a pair of hydraulic or pneumatic cylinders 77 with displaceable piston rods 78 (FIGS. 5A and 5B) which are connected through suitable pivotable linkages 79 to respective slips 80. The linkages are pivotally connected to both the top ends of the piston rods and to the top ends of the slips. The slips include generally planar front gripping surfaces 82, and specially contoured rear surfaces 84 which are designed with such a contour to cause the slips to travel between respective radially outwardly disposed, disengaged positions, and radially inwardly disposed, engaged positions. The rear surfaces of the slips travel along respective downwardly and radially inwardly projecting guiding members 86 which are complementarily contoured and securely connected to the spider body. The guiding members cooperate with the cylinders and linkages to cam the slips radially inwardly and force the slips into the respective engaged positions. Thus, the cylinders (or other actuating means) may be empowered to drive the piston rods downwardly, causing the corresponding linkages to be driven downwardly and therefore force the slips downwardly. The surfaces of the guiding members are angled to force the slips radially inwardly as they are driven downwardly to sandwich the pipe segment 11 between them, with the guiding members maintaining the slips in tight engagement with the pipe segment. To release the pipe segment 11, the cylinders 76 are operated in reverse to drive the piston rods upwardly, which draws the linkages upwardly and retracts the respective slips back to their disengaged positions to release the pipe segment. The guiding members are preferably formed with respective notches 81 which receive respective projecting portions 83 of the slips to lock the slips in the disengaged position (FIG. 5A).

The spider\elevator 74 further includes a pair of diametrically opposed, outwardly projecting ears 88 formed with downwardly facing recesses 90 sized to receive correspondingly formed, cylindrical members 92 at the bottom ends of the respective links 40, and thereby securely connect the lower ends of the links to the spider\elevator. The ears may be connected to an annular sleeve 93 which is received over the housing 75, or may be formed integral with the housing.

In one illustrative embodiment, the pipe running tool 10 includes a load compensator, generally designated 94. The load compensator preferably is in the form of a pair of hydraulic, double rodded cylinders 96, each of which includes a pair of piston rods 98 that are selectively extendable from, and retractable into, the cylinder. The upper rods connect to a compensator clamp 100, which in turn is connected to the lower drive shaft 14, while the lower rods extend downwardly and connect at the respective lower ends to a pair of ears 102 which are securely mounted to the bushing 60. The hydraulic cylinders may be actuated to draw the bushing upwardly relative to the lower drive shaft 14 by applying a pressure to the cylinders which causes the upper piston rods to retract into the respective cylinder bodies, with the splined interface between the bushing and lower drive shaft allowing the bushing to be displaced vertically relative to the shaft. In that manner, the pipe segment 11 carried by the spider\elevator 74 may be raised vertically to relieve a portion or all of the load applied to the pipe segment 11, as is described in greater detail below. As is shown in FIG. 2, the lower rods are at least partially retracted, resulting in the majority of the load from the pipe running tool 10 is assumed by the top drive output shaft 28. In addition, when a load above a preselected maximum is applied to the pipe segment 11, the cylinders 96 will automatically react the load to prevent the entire load from being applied to the threads of the pipe segment.

The pipe running tool 10 still further includes a hoist mechanism, generally designated 104, for hoisting a pipe segment upwardly into the spider\elevator 74. The hoist mechanism is disposed off-axis and includes a pair of pulleys 106 carried by the axle 70, the axle being journaled into the bearings in respective through passageways formed in the arms 64. The hoist mechanism also includes a gear drive, generally designated 108, that may be selectively driven by a hydraulic motor 111 or other suitable drive system to rotate the axle and thus the pulleys. The hoist may also include a brake 115 to prevent rotation of the axle and therefore of the pulleys and lock them in place, as well as a torque hub 116. Therefore, a pair of chains, cables, or other suitable, flexible means may be run over the respective pulleys, extended through a chain well 113, and engaged to the pipe segment 11, and the axle is then rotated by a suitable drive system to hoist the pipe segment vertically and up into position with the upper end of the pipe segment 11 extending into the spider\elevator 74.

The pipe running tool 10 preferably further includes an annular collar 109 which is received over the links 40 and which maintains the links locked to the ears 88 and prevents the links from twisting and/or winding.

In use, a work crew may manipulate the pipe running tool 10 until the upper end of the tool is aligned with the lower end of the top drive output shaft 28. The pipe running tool 10 is then raised vertically until the splined coupler 52 at the lower end of the top drive output shaft is engaged to the upper end of the lower drive shaft 14 and the links 40 are engaged with the ears 93. The work crew may then run a pair of chains or cables over the respective pulleys 106 of the hoist mechanism 104, connect the chains or cables to a pipe segment 11, engage a suitable drive system to the gear 108, and actuate the drive system to rotate the pulleys and thereby hoist the pipe segment upwardly until the upper end of the pipe segment extends through the lower end of the spider\elevator 74. The spider\elevator is then actuated, with the hydraulic cylinders 77 and guiding members 86 cooperating to forcibly drive the respective slips 84 into the engaged positions (FIG. 5B) to positively engage the pipe segment. The slips are preferably advanced to a sufficient extent to prevent relative rotation between the pipe segment and the spider\elevator, such that rotation of the spider\elevator translates into rotation of the pipe segment.

The top drive assembly 24 is then lowered relative to the frame 20 by means of the top hoist 25 to drive the threaded lower end of the pipe segment 11 into contact with the threaded upper end of the pipe string 34 (FIG. 1). As shown in FIG. 1, the pipe string is securely held in place by means of the flush-mounted spider 36 or any other suitable structure for securing the string in place, as is well known to those skilled in the art. Once the threads are properly mated, the top drive motor 26 is then actuated to rotate the top drive output shaft, which in turn rotates the lower drive shaft of the pipe running tool 10 and the spider\elevator 74, which causes the coupled pipe segment to rotate and thereby be threadedly engaged to the pipe string.

In one embodiment, the pipe segment 11 is intentionally lowered until the lower end of the pipe segment rests on the top of the pipe string 34. The load compensator 94 is then actuated to drive the bushing 60 upwardly relative to the lower drive shaft 14 via the splined interface between the two. The upward movement of the bushing causes the spider\elevator 74 and therefore the coupled pipe segment 11 to be raised, thereby reducing the weight on the threads of the pipe segment. In this manner, the load on the threads can be controlled by actuating the load compensator.

Once the pipe segment 11 is threadedly coupled to the pipe string, the top drive assembly 24 is raised vertically to lift the entire pipe string 34, which causes the flush-mounted spider 36 to disengage the string. The top drive assembly 24 is then lowered to advance the string downwardly into the well hole until the upper end of the top pipe segment 11 is close to the drill floor 30, with the entire load of the pipe string being carried by the links 40 while the torque was supplied through shafts. The flush-mounted spider 36 is then actuated to engage the pipe string and suspend it therefrom. The spider\elevator 74 is then controlled in reverse to retract the slips 84 back to the respective disengaged positions (FIG. 5A) to release the pipe string. The top drive assembly 24 is then raised to lift the pipe running tool 10 up to a starting position (such as that shown in FIG. 1) and the process may be repeated with an additional pipe segment 11.

Figure 6:
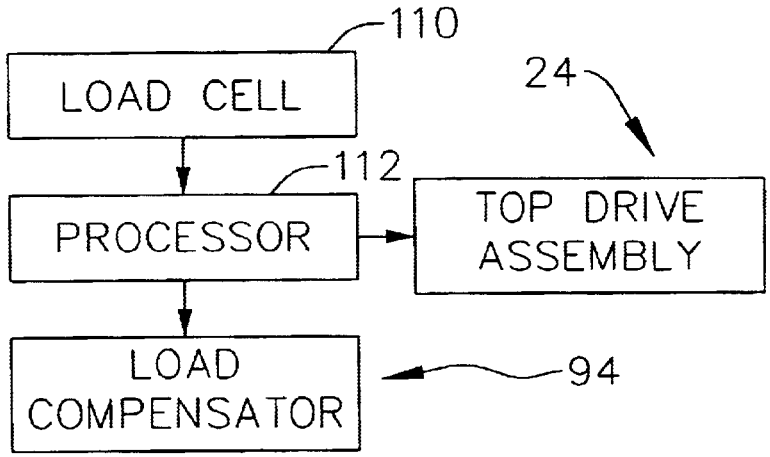
FIG. 6 is a block diagram of components included in one illustrative embodiment of the invention.

Referring to FIG. 6, there is shown a block diagram of components included in one illustrative embodiment of the pipe running tool 10. In this embodiment, the tool includes a conventional load cell 110 or other suitable load-measuring device mounted on the pipe running tool 10 in such a manner that it is in communication with the lower drive shaft 14 to determine the load applied to the lower end of the pipe segment 11. The load cell is operative to generate a signal representing the load sensed, which in one illustrative embodiment is transmitted to a processor 112. The processor is programmed with a predetermined threshold load value, and compares the signal from the load cell with that value. If the load exceeds the value, the processor then controls the load compensator 94 to draw upwardly a selected amount to relieve at least a portion of the load on the threads of the pipe segment. Once the load is at or below the threshold value, the processor controls the top drive assembly 24 to rotate the pipe segment 11 and thereby threadedly engage the pipe segment to the pipe string 34. While the top drive assembly is actuated, the processor continues to monitor the signals from the load cell to ensure that the load on the pipe segment does not exceed the threshold value.

Alternatively, the load on the pipe segment 11 may be controlled manually, with the load cell 110 indicating the load on the pipe segment via a suitable gauge or other display, with a work person controlling the load compensator 94 and top drive assembly 24 accordingly.

Figure 7:
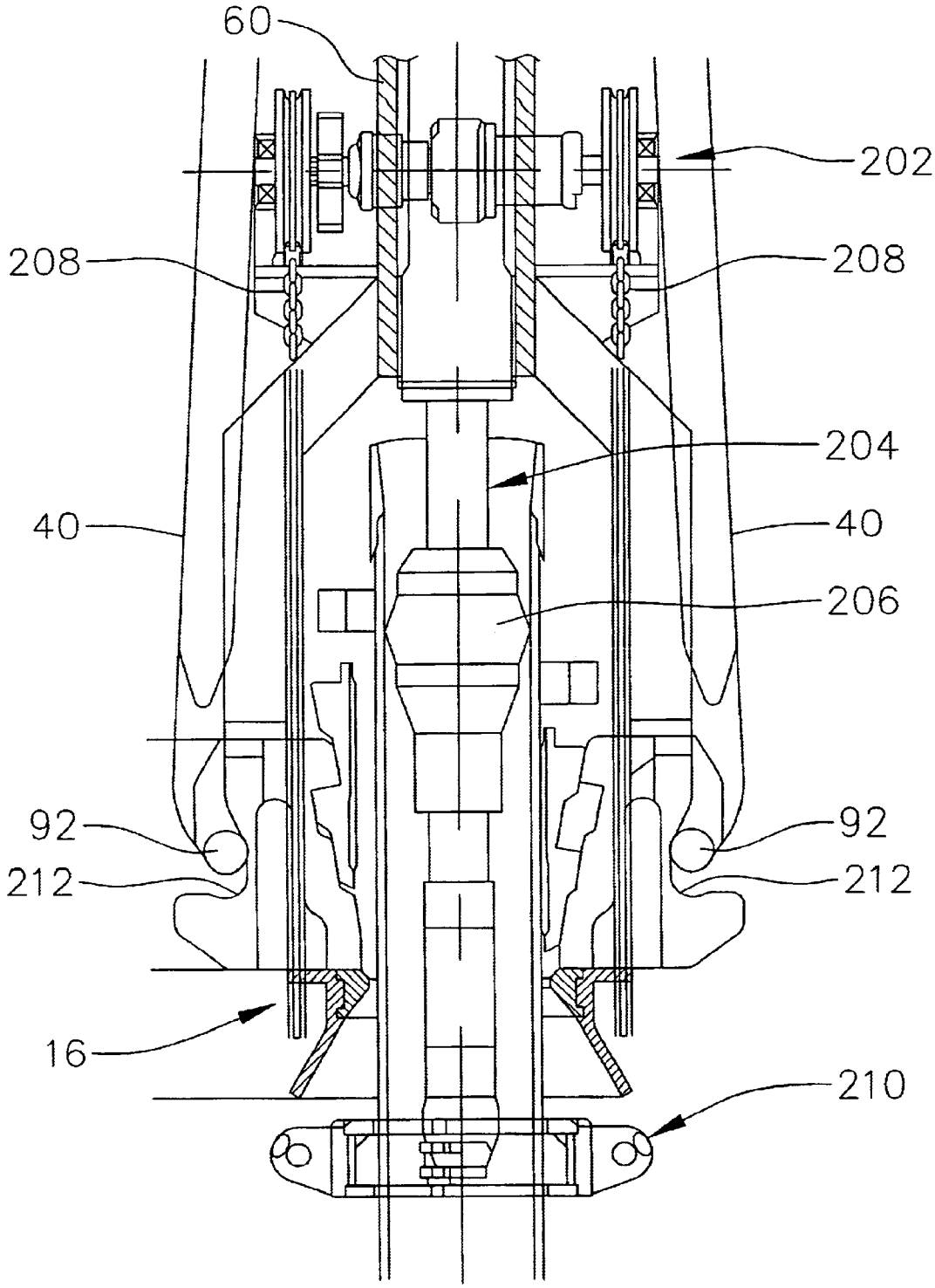
FIG. 7 is a side view of another illustrative embodiment of the invention.

Referring to FIG. 7, there is shown another preferred embodiment of the pipe running tool 200 of the present invention. The pipe running tool includes a hoisting mechanism 202 which is substantially the same as the hoisting mechanism 104 described above. A lower drive shaft 204 is provided and connects at its lower end to a conventional mud-filling device 206 which, as is known in the art, is used to fill a pipe segment, for example, a casing segment, with mud during the assembly process. In one illustrative embodiment, the mud-filling device is a device manufactured by Davies-Lynch Inc. of Texas.

The hoisting mechanism 202 supports a pair of chains 208 which engage a slip-type single joint elevator 210 at the lower end of the pipe running tool 200. As is known in the art, the single joint elevator is operative to releasably engage a pipe segment 11, with the hoisting mechanism 202 being operative to raise the single joint elevator and pipe segment upwardly and into the spider\elevator 74.

The tool 200 includes the links 40 which define the cylindrical lower ends 92 which are received in generally J-shaped cut-outs 212 formed in diametrically opposite sides of the spider\elevator 74.

Figure 8D:
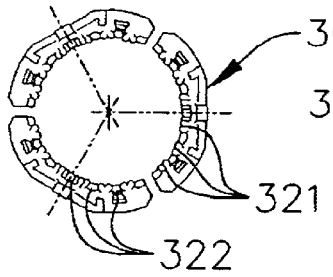
FIG. 8D is a top view of an illustrative embodiment of an insert carrier according to the invention.
Figure 8B:
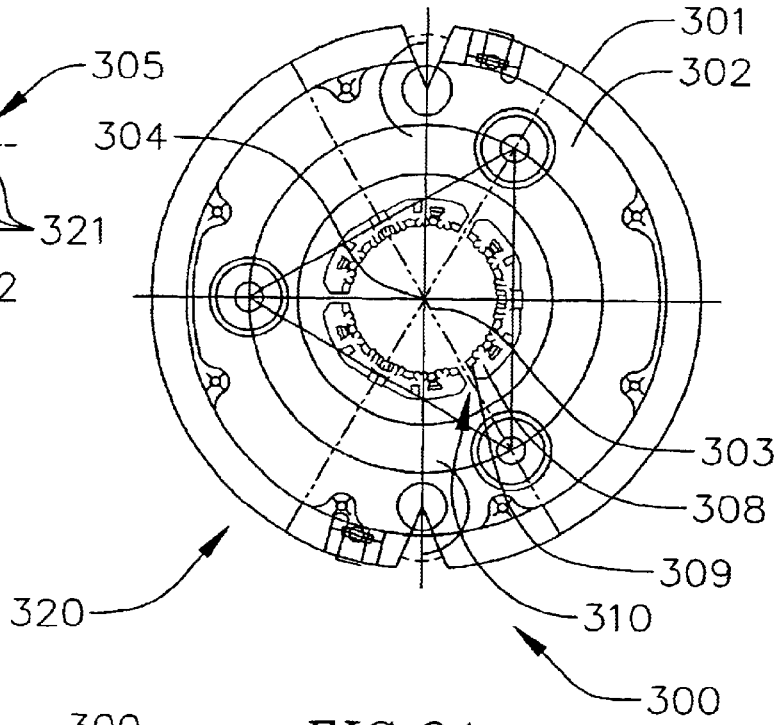
FIG. 8B is a top view of an illustrative embodiment of the invention having a greater offset elevator.
Figure 8C:
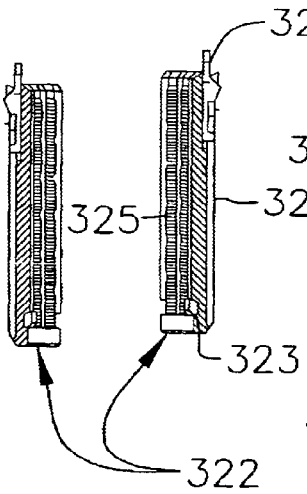
FIG. 8C is a perspective view of an illustrative embodiment of an insert carrier according to the invention.
Figure 8A:
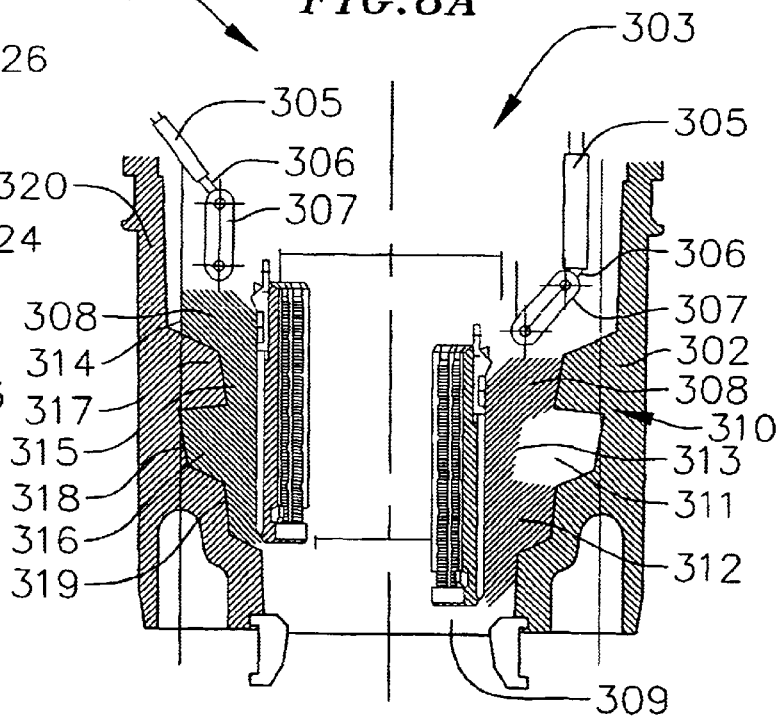
FIG. 8A is a side view of an illustrative embodiment of the invention having a greater offset elevator.

Referring now to FIGS. 8A and 8B, there is shown a system 300 for greater elevator offset according to another aspect of the invention. As in the embodiment discussed with relation to FIGS. 5A and 5B above, the greater offset spider\elevator 301 according to the present invention includes a housing 302 which defines a central passageway 303 through which the pipe segment 304 may pass. The spider\elevator 301 also includes at least a pair of hydraulic or pneumatic cylinders 305 with displaceable piston rods 306 (FIGS. 8A and 8B), which are connected through suitable pivotable linkages 307 to respective slips 308. The linkages 307 are pivotally connected to both the top ends of the piston rods 306 and to the top ends of the slips 308. In addition, the slips 308 of the greater offset elevator of the current embodiment may include conventional generally planar front gripping surfaces 309.

As in the conventional slip design, the rear surfaces of the slips 308 travel along respective downwardly and radially inwardly projecting guiding members 310, which are complementarily contoured and securely connected to the spider body 302. The guiding members 310 cooperate with the cylinders 305 and linkages 307 to cam the slips 308 radially inwardly and force the slips into the respective engaged positions. Thus, the cylinders 305 (or other actuating means) may be empowered to drive the piston rods 306 downwardly, causing the corresponding linkages 307 to be driven downwardly and therefore force the slips 308 downwardly. The surfaces of the guiding members 310 are angled to force the slips 308 radially inwardly as they are driven downwardly to sandwich the pipe segment 304 between them, with the guiding members maintaining the slips in tight engagement with the pipe segment. To release the pipe segment 304, the cylinders 305 are operated in reverse to drive the piston rods 306 upwardly, which draws the linkages 307 upwardly and retracts the respective slips 308 back to their disengaged positions to release the pipe segment. The guiding members 310 are preferably formed with respective notches 311 which receive respective projecting portions 312 of the slips to lock the slips in the disengaged position (FIG. 8A).

However, as shown in FIGS. 8A and 8B, the slips 308 of this embodiment have specially contoured rear surfaces 313 having downwardly tapering frustoconical wedge surfaces 314, 315 and 316, which are designed with such a contour so as to engage correspondingly shaped wedge surfaces 317, 318 and 319 on the slip bowl body sections 320 such that the wedge surfaces on both the slips and the slip bowl are received in corresponding recesses to maximize the movement of the slip radially outward from its active gripping position, thereby allowing reception between the retracted slips of casing, drill pipe, and even large joints or enlargements on pipe. During operation, then, downward or upward movement of the slips 308 not only cause the slips to travel between respective radially outwardly disposed, disengaged positions, and radially inwardly disposed, engaged positions, but also allow the slips to withdraw further into the slip bowl body 320 such that the diameter of the central passageway 303 may be enlarged to accommodate both conventional casing and drill pipe and drill pipe joints. For example, conventional spider\elevator designs have an retracted offset of only about 1 inch, and consequently have a central passageway 303 having a diameter of only about 16" to 16.5" inches. Such an opening only allows the insertion of conventional casing sizes. In the embodiment shown in FIG. 8, the deeply undercut inner surfaces and wedge surfaces of the spider\elevator provide a retracted position offset greater than 1 inch, providing a central passageway 303 having a diameter of ~22" inch allowing the insertion of drill pipe tool joints without interfering with the front surfaces 309 of the slips. Accordingly, the slip of ths design can be utilized to back-up both casing and drill pipe.

In this embodiment, as before, the spider\elevator 301 is preferably powered by a hydraulic or pneumatic system, or alternatively by an electric drive motor or any other suitable powered system. In one preferred embodiment, the greater offset spider\elevator 301 has a 3-slip design, as shown in FIGS. 8A and 8B and discussed above, powered with three five-inch diameter cylinders 305. Such a design provides greater down force power for centering and backing up pipe and the 3-slip design allows the central passageway 303 of the spider\elevator 301 to be enlarged allowing large bits, pipe and casing to be run through the pipe running tool system 300.

Figure 5B:
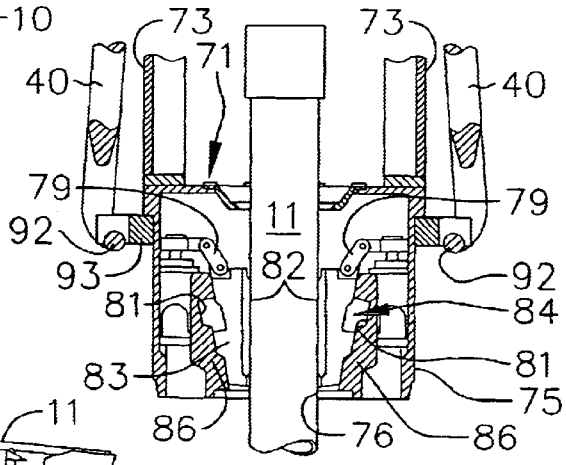
FIG. 5B is a cross-sectional view similar to FIG. 5A and showing the spider\elevator in an engaged position.

As in the conventional spider/elevator described in relation to FIGS. 5A and 5B, the spider\elevator 301 illustrated in FIGS. 8A and 8B may further include a pair of diametrically opposed, outwardly projecting ears formed with downwardly facing recesses sized to receive correspondingly formed, cylindrical members at the bottom ends of the respective links, and thereby securely connect the lower ends of the links to the spider\elevator. The ears may be connected to an annular sleeve, which is received over the housing, or may be formed integral with the housing.

Finally, although slips having conventional planar front gripping surfaces 309 are described above, the front surfaces 309 of the slips 308 may be designed with a groove 321 which allows the insertion of a insert carrier 322, as shown in FIGS. 8C and 8D. The insert carriers 322 comprise a body 323 having a back surface 324 designed as a wedge to engage the groove in the front surface of the slip body 308. The front surface 325 of the insert carrier is designed with a toothed gripping surface designed to gripingly engage the tubular member introduced into the central passageway 303 of the spider\elevatore 301. Although the insert carrier 322 of the current embodiment may be secured to the slip face 309 through any conventional engagement means, in a preferred embodiment, the insert carrier is secured to the slip 308 via a single hing pin 326 as shown in FIG. 8D such that the insert carrier may be quickly engaged and removed from the slip body. Although only one insert carrier design is shown in FIGS. 8C and 8D, it should be understood that slip inserts having a variety of dimensions may be manufactured to optimally engage a variety of different casing and pipe sizes such that pipes and casings of different sizes may be handle by the pipe running tool of the current embodiment by changing the insert carriers and without the need to change out the slip set itself.

From the foregoing, it will be apparent that the pipe running tool 10 efficiently utilizes an existing top drive assembly to assemble a pipe string, for example, a casing or drill string, and does not rely on cumbersome casing tongs and other conventional devices. The pipe running tool incorporates the spider\elevator 74 or 301, which not only carries pipe segments, but also imparts rotation to them to threadedly engage the pipe segments to an existing pipe string. Thus, the pipe running tool provides a device which grips and torques the pipe segment 11, and which also is capable of supporting the entire load of the pipe string as it is lowered down into the well hole.

Figure 9:
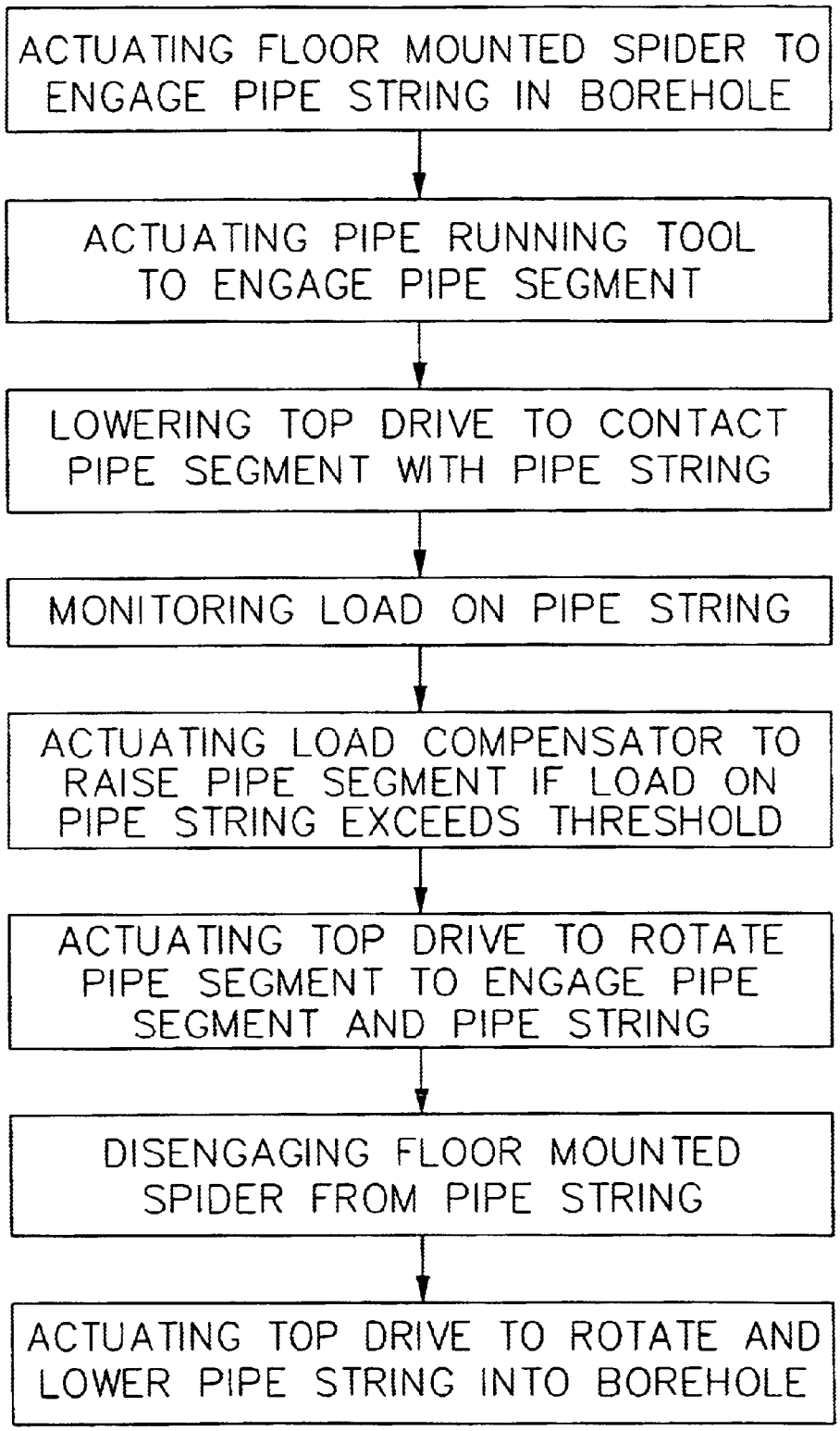
FIG. 9 is a flowchart of an illustrative embodiment of a method of using the pipehandling tool of the invention.

Referring to FIG. 9, the pipe running tool 10 may also be utilized to drive pipe and/or casing into a borehole. In such an embodiment, an assemble pipe string (assembled via any of the methods described above) would be supported in an embodiment of the spider\elevator 74 or 301 described above. The top drive would then be activated to rotate and lower the spider\elevator, which in turn would transmit the rotational and vertical motion of the top drive to the pipe segment such that the pipe string would be inserted into the borehole. Although the pipe string could be inserted without imparting a rotational motion, rotating the pipe string as it is lowered into the borehole helps prevent the pipe string from seizing and becoming stuck in the borehole. Likewise, when removing a pipe string it is like wise advantageous to provide rotational motion to the pipe string to ensure that the pipe string does not seize.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A pipe running tool mountable on a rig for use in handling pipe segments and for engaging the pipe segments to a string of pipe, the pipe running tool comprising:

a top drive assembly adapted to be connected to the rig for vertical displacement of the top drive assembly relative to the rig, the top drive assembly including a drive shaft, the top drive assembly being operative to rotate the drive shaft; and a lower pipe engagement assembly including a central passageway sized for receipt of the pipe segment, the lower pipe engagement assembly including a powered pipe engaging mechanism that is selectively driven into a pipe engagement position to forcibly yet releasably engage the pipe segment and substantially prevent relative rotation therebetween, the powered pipe engaging mechanism comprising:

a slip bowl defining a generally cylindrical central passageway, and a plurality of slips receivable within and movable relative to said slip bowl, wherein each of said plurality of slips has two vertically spaced outer camming surfaces which taper to a reduced diameter as they advance downwardly, and a recess extending radially inwardly vertically between said camming surfaces, the slip bowl having a vertically extending side wall with two vertically spaced camming surfaces formed at the inside thereof, which surfaces taper essentially in correspondence with the surfaces of the each of the plurality of slips and are engageable therewith in a lowered active position of the slip, the side wall of the slip bowl containing a recess vertically spaced between the two spaced camming surfaces of the bowl and into which a lower one of said two camming surfaces on each of the plurality of slips is movable in an upper retracted position such that the central passageway can accommodate a drillpipe tool joint, wherein the lower pipe engagement assembly is in communication with the drive shaft, whereby actuation of the top drive assembly causes the lower pipe engagement assembly to rotate.

2. The pipe running tool of claim 1, further including a hoist mechanism connected to the lower pipe engagement assembly and operative to hoist a pipe segment into the central passageway of the lower pipe engagement assembly.

3. The pipe running tool of claim 2, wherein the hoist mechanism comprises an axle journaled to the lower pipe engagement member, a pair of pulleys rotatably mounted to the axle, and a gear connected to the axle, whereby the gear may be coupled to a drive system for rotating the axle.

4. The pipe running tool of claim 1, wherein each of the plurality of slips include at least one insert carrier releasably connected to the inner face thereof and having an inner face designed to grippingly engage the pipe segment.

5. The pipe running tool of claim 4, wherein the at least one insert carrier is secured to the slip by a tongue and groove construction.

6. The pipe running tool of claim 1, wherein the lower pipe engagement assembly is powered by one of a hydraulic system and a pneumatic system.

7. The pipe running tool of claim 1, further including a block connected to the top drive assembly and adapted for engaging a plurality of cables connected to the rig.

8. The pipe running tool of claim 7, wherein the drive members comprise hydraulic lift cylinders.

9. A pipe running tool mountable on a rig and designed for use in handling pipe segments and for engaging pipe segments to a pipe string, the pipe running tool comprising:

a top drive assembly adapted to be connected to the rig, the top drive assembly including a top drive output shaft, the top drive assembly being operative to rotate the drive shaft;

a lower drive shaft coupled to the top drive output shaft and comprising an adjustable segment that is selectively adjustable to adjust the length of the second drive shaft;

a lower pipe engagement assembly including a central passageway sized for receipt of the pipe segment, the lower pipe engagement assembly being operative to releasably grasp the pipe segment, the lower pipe engagement assembly being connected to the second drive shaft, whereby actuation of the top drive assembly causes the lower pipe engagement assembly to rotate, the powered pipe engaging mechanism comprising:

a slip bowl defining a generally cylindrical central passageway, and a plurality of slips receivable within and movable relative to said slip bowl, wherein each of said plurality of slips has two vertically spaced outer camming surfaces which taper to a reduced diameter as they advance downwardly, and a recess extending radially inwardly vertically between said camming surfaces, the slip bowl having a vertically extending side wall with two vertically spaced camming surfaces formed at the inside thereof, which surfaces taper essentially in correspondence with the surfaces of the each of the plurality of slips and are engageable therewith in a lowered active position of the slip, the side wall of the slip bowl containing a recess vertically spaced between the two spaced camming surfaces of the bowl and into which a lower one of said two camming surfaces on each of the plurality of slips is movable in an upper retracted position such that the central passageway can accommodate a drillpipe tool joint; and means for applying a force to the second shaft to cause the length of the adjustable segment to be shortened.

10. The pipe running tool of claim 9, wherein the means for applying comprises a load compensator in the form of a pair of hydraulic cylinders.

11. The pipe running tool of claim 9, wherein the lower pipe engagement assembly is actuated by one of a hydraulic system and a pneumatic system.

12. The pipe running tool of claim 9, wherein each of the plurality of slips include at least one insert carrier releasably connected to the inner face thereof and having an inner face designed to grippingly engage the pipe segment.

13. The pipe running tool of claim 9, further including a block connected to the top drive assembly and adapted for engaging a plurality of cables connected to the rig to selectively raise and lower the top drive assembly.

14. A pipe running tool mountable on a rig and designed for use in connection with a top drive assembly adapted to be connected to the rig for vertical displacement of the top drive assembly relative to the rig, the top drive assembly including a drive shaft, the top drive assembly being operative to rotate the drive shaft, the pipe running tool comprising:

a lower pipe engagement assembly comprising:

a housing defining a central passageway sized for receipt of a pipe segment, the housing being coupled to the top drive assembly for rotation therewith;

a slip bowl defining a generally cylindrical central passageway;

a plurality of slips receivable within and movable relative to said slip bowl, wherein each of said plurality of slips has two vertically spaced outer camming surfaces which taper to a reduced diameter as they advance downwardly, and a recess extending radially inwardly vertically between said camming surfaces, the slip bowl having a vertically extending side wall with two vertically spaced camming surfaces formed at the inside thereof, which surfaces taper essentially in correspondence with the surfaces of the each of the plurality of slips and are engageable therewith in a lowered active position of the slip, the side wall of the slip bowl containing a recess vertically spaced between the two spaced camming surfaces of the bowl and into which a lower one of said two camming surfaces on each of the plurality of slips is movable in an upper retracted position such that the central passageway can accommodate a drillpipe tool joint; and a powered system connected to the respective slips and operative to selectively drive the slips between the disengaged and engaged positions.

15. The pipe running tool of claim 14, further including a hoist mechanism connected to the lower pipe engagement assembly and operative to hoist a pipe segment into the central passageway of the lower pipe engagement assembly.

16. The pipe running tool of claim 15, wherein the hoist mechanism comprises an axle journaled to the lower pipe engagement member, a pair of pulleys rotatably mounted to the axle, and a gear connected to the axle, whereby the gear may be coupled to a drive system for rotating the axle.

17. The pipe running tool of claim 14, wherein the powered system comprises one of a hydraulic and pneumatic system.

18. The pipe running tool of claim 14, further including a block connected to the top drive assembly and adapted for engaging a plurality of cables connected to the rig.

19. In a system for assembling a pipe string comprising a floor mounted pipe engagement assembly, a top drive assembly, a lower pipe engagement assembly coupled to the top drive assembly for rotation therewith and operative to releasably engage a pipe segment, and a load compensator operative to raise the lower pipe engagement assembly relative to the top drive assembly, a method for threadedly engaging a pipe segment with a pipe string and inserting a pipe string into a borehole, comprising the steps of:

actuating the floor mounted pipe engagement assembly to releasably engage the pipe string in the borehole;

actuating the lower pipe engagement assembly to releasably engage a pipe segment;

lowering the top drive assembly to bring the pipe segment into contact with the pipe string;

monitoring the load on the pipe string;

actuating the load compensator to raise the pipe segment a selected distance relative to the pipe string, if the load on the pipe string exceeds a predetermined threshold value;

actuating the top drive assembly to rotate the pipe segment to threadedly engage the pipe segment and pipe string;

disengaging the floor mounted pipe engagement assembly from the pipe string in the borehole; and actuating the top drive assembly to rotate and lower the pipe string supported by the lower pipe engagement assembly into the borehole.

* * * * *